US008360154B2

(12) United States Patent
Mohon et al.

(10) Patent No.: US 8,360,154 B2
(45) Date of Patent: Jan. 29, 2013

(54) FLOW DIVERTER RING FOR MUD SAVER VALVES

(75) Inventors: Brian Mohon, Spring, TX (US); Vishal Saheta, Houston, TX (US)

(73) Assignee: Smith International, Inc., Houston, TX (US)

( * ) Notice: Subject to any disclaimer, the term of this patent is extended or adjusted under 35 U.S.C. 154(b) by 183 days.

(21) Appl. No.: 12/702,006

(22) Filed: Feb. 8, 2010

(65) Prior Publication Data

US 2011/0192649 A1 Aug. 11, 2011

(51) Int. Cl.
*E21B 34/00* (2006.01)

(52) U.S. Cl. ..... 166/324; 166/316; 166/321; 166/334.1; 175/218

(58) Field of Classification Search ..... 166/321, 166/334.1, 332.1, 334.4; 137/356
See application file for complete search history.

(56) References Cited

U.S. PATENT DOCUMENTS 2,152,794 A * 4/1939 Dripps ..... 137/467
3,877,480 A * 4/1975 Hughes et al. ..... 137/329.06
4,566,485 A * 1/1986 Ruhle ..... 137/375
4,658,905 A 4/1987 Burge
4,779,688 A * 10/1988 Baugh ..... 175/218
2011/0192649 A1 8/2011 Mohon et al.

OTHER PUBLICATIONS

Combined Search and Examination Report issued in corresponding British Application No. GB1102105.2; dated Mar. 18, 2011 (6 pages).
Examination Report issued in corresponding British Application No. GB1102105.2; dated Apr. 12, 2012 (2 pages).
Examination Report issued in corresponding British Application No. GB1102105.2; dated Nov. 6, 2012 (2 pages).

* cited by examiner

*Primary Examiner* — Daniel P Stephenson
*Assistant Examiner* — Ronald Runyan
(74) *Attorney, Agent, or Firm* — Osha Liang LLP

(57) ABSTRACT

A valve assembly includes a main housing having a central bore therethrough, an upper valve subassembly disposed within the main housing, the upper valve subassembly including an upper seat configured to contact a corresponding lower seat of a lower valve subassembly, and a flow diverter ring disposed proximate the upper seat of the upper valve subassembly, wherein the flow diverter ring is configured to direct a fluid flow radially away from the upper seat of the upper valve subassembly.

20 Claims, 2 Drawing Sheets

FLOW DIVERTER RING FOR MUD SAVER VALVES

BACKGROUND

1. Field of the Disclosure

Embodiments disclosed herein relate generally to mud saver valves for saving drilling fluid. In particular, embodiments disclosed herein relate to a mud saver valve in a drillstring for saving drilling mud in the upper drillstring while a new drill pipe connection is made below the mud saver valve.

2. Background Art

During well drilling operations multiple joints of drill pipe may be added to a drillstring by first disconnecting an upper portion of the drillstring and then installing a new piece of drill pipe between the disconnected upper and lower portions of the drillstring. During such a connection procedure ("make-up") or during a similar disconnection procedure ("break-out"), drilling fluid or mud within the upper drillstring may be lost unless some type of valve apparatus closes off the upper drillstring to hold drilling mud therein. One device that may be used to close off fluid flow through the upper drillstring is a mud saver valve, which is between a kelly (a component used to transmit rotary motion from the rotary table to the drillstring) and the upper portion of the drillstring. The mud saver valve operates in response to drilling fluid pressure, i.e., the mud saver valve may be closed when mud pumps are turned off and opened when the mud pumps are again turned on. Within the mud saver valve, an upper seat (typically a rubber seat) and a lower seat (typically a carbide seat) are configured to move into and out of sealing contact in response to these changes in drilling fluid pressure.

A typical size for mud saver valves used in drilling operations may be a 6½ inch mud saver valve. The 6½ inch valve may provide a streamlined fluid flow path, reduced localized velocities near the upper and lower seats in the mud saver valve, and increased run time of more than 30 days before required service. Smaller mud saver valve sizes are also available, particularly a 4¾ inch valve size. However, smaller valve sizes have experienced problems with erosion near the rubber upper seat due to increased fluid velocities in the upper seat region. Erosion of the rubber upper seat has reduced the service life of the smaller mud saver valves, thus requiring increased maintenance and downtime.

Accordingly, there exists a need for an apparatus to reduce or prevent erosion of the upper rubber seat in smaller mud saver valve sizes.

SUMMARY OF THE DISCLOSURE

In one aspect, embodiments disclosed herein relate to a valve assembly including a main housing having a central bore therethrough, an upper valve subassembly disposed within the main housing, the upper valve subassembly including an upper seat configured to contact a corresponding lower seat of a lower valve subassembly, and a flow diverter ring disposed proximate the upper seat of the upper valve subassembly, wherein the flow diverter ring is configured to direct a fluid flow radially away from the upper seat of the upper valve subassembly.

In other aspects, embodiments disclosed herein relate to a method of reducing wear of an upper seat of a mud saver valve, the method including disposing a flow diverter ring proximate the upper seat, wherein the flow diverter ring is configured to direct a fluid flow radially away from the upper seat.

Other aspects and advantages of the invention will be apparent from the following description and the appended claims.

DETAILED DESCRIPTION

In one aspect, embodiments disclosed herein relate to a drilling mud saver valve, which is useful in conjunction with a kelly (or similar device) in a drillstring to close and save mud in the kelly (and mud above the kelly) during make-up or break-out of drillstring joints. The drilling mud saver valve may be installed between a drill kelly and the drillstring, and operates in response to fluid pressure that builds up when the pumps are turned on.

Figure 1:
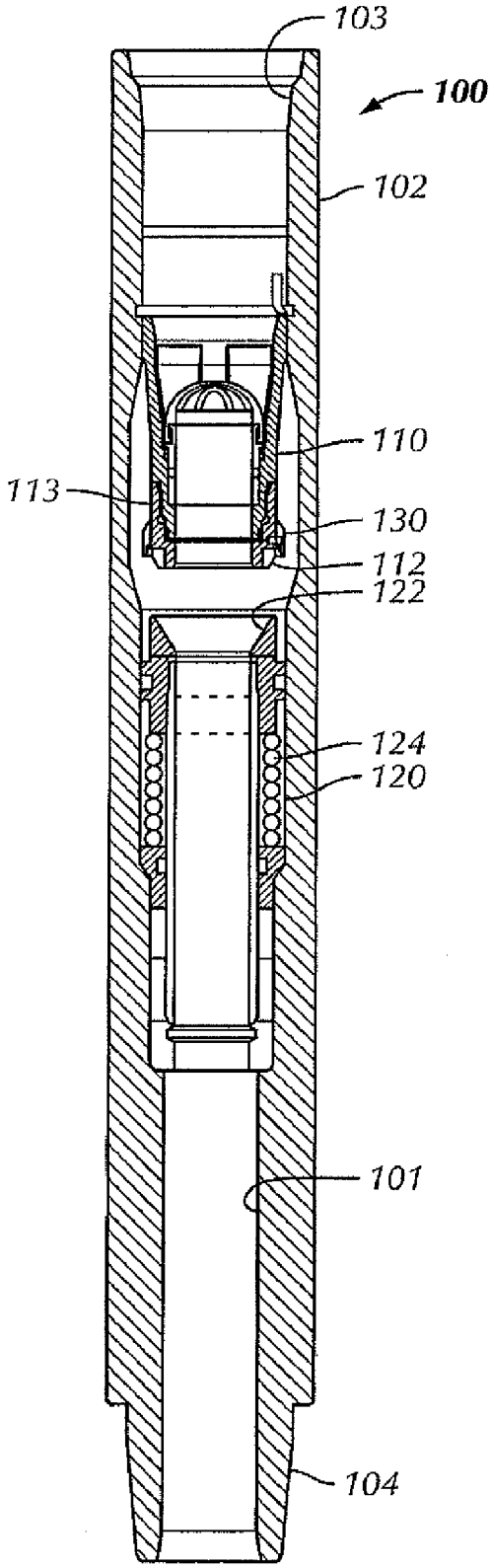
FIG. 1 is a cross-sectional view of a mud saver valve in accordance with embodiments of the present disclosure.

Referring to FIG. 1, a cross-sectional view of a drilling mud saver valve 100 is shown in accordance with embodiments of the present disclosure. Drilling mud saver valve 100 includes a main housing 102 having a central bore 101 therethrough and having an upper threaded end 103 for engaging a device such as the kelly (not shown) on a drillstring and a lower threaded end 104 for engaging an uppermost drill pipe member (not shown) of the drillstring.

Drilling mud saver valve 100 further includes an upper valve subassembly 110, which is fixed relative to main housing 102, and a lower valve subassembly 120, which is configured to move axially within main housing 102. Upper valve subassembly 110 includes an upper seat 112 mounted on a lower end of a inner mandrel 113. Lower valve subassembly 120 includes a lower seat 122 that is configured to contact upper seat 112. Upper seat 112 may be a rubber seat and lower seat 122 may be a carbide seat. Alternatively, upper seat 112 may be a carbide seat and lower seat 122 may be a rubber seat.

An increased drilling fluid pressure may force lower seat 122 axially downward and out of sealing contact with upper seat 112 to allow drilling fluid to pass through central bore 101 during drilling operations. To close the mud saver valve 100 (e.g., during make-up or break-out of drillstring joints), pumping of drilling fluid may be stopped or decreased to reduce drilling fluid pressure and allow biasing mechanism (e.g., spring) 124 to move lower seat 122 upward and into sealing contact with upper seat 112. During an ensuing joint connection procedure, the mud saver valve remains closed until the joint is made and drilling fluid is again pumped down the drillstring under pressure to reopen mud saver valve 100.

Figure 2:
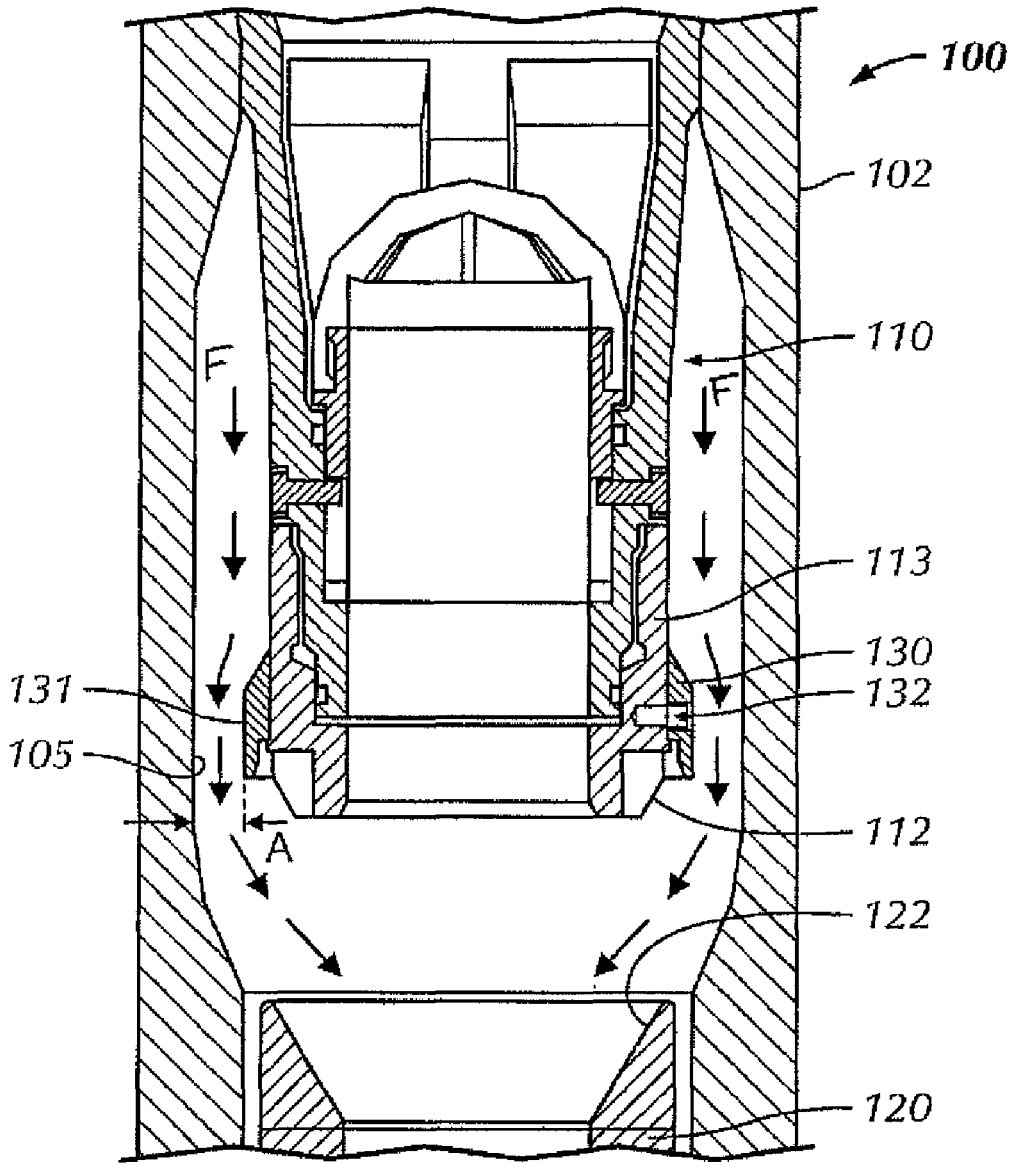
FIG. 2 is a detailed cross-sectional view of the mud saver valve and a flow diverter ring in accordance with embodiments of the present disclosure.

Referring now to FIG. 2, a detailed cross-sectional view of upper valve subassembly 110 is shown in accordance with embodiments of the present disclosure. Upper valve subassembly 110 includes a flow diverter ring 130 mounted proximate upper seat 112 and attached to inner mandrel 113. Flow diverter ring 130 may be secured proximate upper seat 112 with set screws 132, which engage inner mandrel 113, or other fastening devices known to those skilled in the art, and thus is replaceable. In alternate embodiments, flow diverter ring 130 may be formed integral with upper seat 112. Flow diverter ring 130 may be manufactured from steel or other metal and have a smooth outer surface over which fluid may flow. In certain embodiments, flow diverter ring 130 may have a High Velocity Oxygen Fuel ("HVOF") coating applied to its surfaces to prolong the life of the flow diverter ring.

Flow diverter ring 130 is configured as a radially outward protruding ring that is configured to direct a high velocity fluid flow F away from upper seat 112. As previously mentioned, fluid flow F through the mud saver valve 100 may reach very high velocities near upper seat 112, which leads to erosion and premature failure of the rubber material of upper seat 112. Flow diverter ring 130 is configured to partially cover upper seat 112 (i.e., extend over upper seat 112 in an axial direction), rather than completely cover upper seat 112. Applicant has determined through computational fluid dynamics ("CFD") analysis that full coverage or overlap of flow diverter ring 130 over an axial length of upper seat 112 increases erosion of upper seat 112. Thus, an axial length of flow diverter ring 130 of embodiments disclosed herein has been optimized to provide adequate erosion protection of upper seat 112 by only providing partial coverage (i.e., extending partially over an axial length) of upper seat 112. In certain embodiments, flow diverter ring 130 may be optimized to cover only about one-third to about one-half of an axial length of upper seat 112.

Flow diverter ring 130 may also be configured to extend outward in the radial direction a certain amount to create an optimal annulus A between an outer surface 131 of flow diverter ring 130 and an inner wall 105 of main housing 102. By creating an optimized annulus A with flow diverter ring 130, fluid velocities in the upper seat 112 region may be reduced to further prevent erosion of the rubber seat of upper seat 112. For example, CFD analysis on a smaller mud saver valve (4¾ inch mud saver valve) having an optimized annulus A of 0.367 inches showed a reduction of fluid velocity from over 20 feet per second down to about 9 feet per second using a flow diverter ring in accordance with embodiments disclosed herein. In certain embodiments, the optimized annulus A for a 4¾ inch mud saver valve may be between 0.35 and 0.4 inches.

Methods of using the flow diverter ring 130 include securing the flow diverter ring 130 with set screws 132 (or other fasteners) to inner mandrel 113 at a location proximate upper seat 112. Flow diverter ring 130 may be secured such that the flow diverter ring 130 overlaps or extends axially over upper seat 112 only partially by a specified amount. The amount of overlap should be about one-third to about one-half of the axial length of upper seat 112. As shown in FIG. 2, during operation fluid flow F may flow along an outer surface of upper valve subassembly 110 until it reaches flow diverter ring 130. Flow diverter ring 130 then reroutes fluid flow F radially outward and away from upper seat 112. Fluid flow F may then continue downward past lower seat 122 through the central bore of main housing 102.

Advantageously, embodiments of the present disclosure may provide a flow diverter ring capable of preventing erosion of the upper rubber seat in a mud saver valve, thereby prolonging the life of the mud saver valve. Further, the flow diverter ring is designed to be replaceable so that the mating upper seat may be reused even after the flow diverter ring exceeds its life.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A valve assembly comprising:

a main housing having a central bore therethrough;

an upper valve subassembly disposed within the main housing, the upper valve subassembly comprising an upper seat configured to contact a corresponding lower seat of a lower valve subassembly; and a flow diverter ring disposed proximate the upper seat of the upper valve subassembly and extending partially over the upper seat in an axial direction;

wherein the flow diverter ring is configured to direct a fluid flow radially away from the upper seat of the upper valve subassembly.

2. The valve assembly of claim 1, wherein the flow diverter ring comprises:

a radially outward protrusion configured to direct fluid radially away from the upper seat;

wherein an optimized annulus is formed between an outer surface of the flow diverter ring and an inner wall of the main housing.

3. The valve assembly of claim 2, wherein the optimized annulus is configured to reduce the fluid flow to a specified velocity.

4. The valve assembly of claim 3, wherein the specified velocity of the fluid flow is about 9 feet per second.

5. The valve assembly of claim 2, wherein the optimized annulus has a radial distance between the outer surface of the flow diverter ring and the inner wall of the main housing of between 0.35 and 0.4 inches.

6. The valve assembly of claim 1, wherein contact between the upper seat and the lower seat prevents fluid flow through the valve assembly.

7. The valve assembly of claim 1, the lower valve subassembly comprising a biasing mechanism configured to force the upper seat into contact with the lower seat.

8. The valve assembly of claim 1, wherein the flow diverter ring is removably attached to the upper valve subassembly.

9. The valve assembly of claim 8, wherein the flow diverter ring is attached to the upper valve subassembly with one or more set screws.

10. The valve assembly of claim 1, wherein the flow diverter ring extends axially over one-third to one-half of the upper seat.

11. The valve assembly of claim 1, wherein the upper valve seat is formed of rubber.

12. The valve assembly of claim 1, wherein the lower valve seat is foamed of carbide.

13. A method of reducing wear of an upper seat of a mud saver valve, the method comprising:

disposing a flow diverter ring proximate the upper seat such that the flow diverter ring partially extends over the upper seat in an axial direction;

wherein the flow diverter ring is configured to direct a fluid flow radially away from the upper seat.

14. The method of claim 13, further comprising creating an optimized annulus between an outer surface of the flow diverter ring and an inner surface of the mud saver valve.

15. The method of claim 14, wherein the optimized annulus is configured to reduce a velocity of the fluid flow near the upper seat.

16. The method of claim 15, wherein the velocity of the fluid flow near the upper seat is reduced from above 20 feet per second to about 9 feet per second.

17. A drill string, comprising:

a valve assembly comprising:

a main housing having a central bore therethrough;

an upper valve subassembly disposed within the main housing, the upper valve subassembly comprising an upper seat configured to contact a corresponding lower seat of a lower valve subassembly; and a flow diverter ring disposed proximate the upper seat of the upper valve subassembly and extending partially over the upper seat in an axial direction;

wherein the flow diverter ring is configured to direct a fluid flow radially away from the upper seat of the upper valve subassembly.

18. The drill string of claim 17, further comprising a drill kelly.

19. The drill string of claim 18, wherein the valve assembly is disposed between the drill kelly and an upper portion of the drill string.

20. The drill string of claim 17, wherein the flow diverter ring comprises:

a radially outward protrusion configured to direct fluid radially away from the upper seat;

wherein an optimized annulus is formed between an outer surface of the flow diverter ring and an inner wall of the main housing.

* * * * *